United States Patent [19]

Fu

[11] Patent Number: 4,940,185

[45] Date of Patent: Jul. 10, 1990

[54] SAFETY EXHAUST VALVE EQUIPPED SPRAY GUN

[76] Inventor: Hsueh-Chin Fu, No. 1, Lane 18, Ta Wei Rd., Ta Li Hsiang, Taichung Hsien, Taiwan

[21] Appl. No.: 282,238

[22] Filed: Dec. 9, 1988

[51] Int. Cl.[5] ..... B05B 7/32

[52] U.S. Cl. ..... 239/126; 239/347; 239/366

[58] Field of Search ..... 239/126, 347, 348, 365, 239/366, 368, 369

[56] References Cited

U.S. PATENT DOCUMENTS

| | | | |
|---|---|---|---|
| 2,052,362 | 8/1936 | Roselund | 239/366 |
| 2,880,940 | 4/1959 | Briggs | 239/365 |
| 2,938,305 | 5/1960 | Bipes | 239/366 |
| 3,463,397 | 8/1969 | Mecklin et al. | 239/126 |
| 4,022,381 | 5/1977 | Karliner | 239/126 |
| 4,174,070 | 11/1979 | Lau et al. | 239/347 |

*Primary Examiner*—Andres Kashnikow
*Assistant Examiner*—Karen B. Merritt
*Attorney, Agent, or Firm*—Varndell Legal Group

[57] ABSTRACT

A safety exhaust valve equipped spray gun including a safety exhaust valve provided on the bottle cover above the bottle connecting portion for maintaining air pressure transmitted into the bottle body through an air induction hole within a limited range, by providing a steel ball which is removed from an air exhaust when the pressure exceeds the limited range so that excessive air pressure is exhausted through an exhausted hole and the inner pressure is constantly kept within the limited range. A pressure stabilizing bolt is provided on the air induction hole of the nozzle so that spraying is effectively achieved by providing a fine spraying effect. By means of this arrangement, the spray gun of the present invention insures against explosion and provides a maximum security effect and is practical for both high pressure and low pressure application.

2 Claims, 3 Drawing Sheets

SAFETY EXHAUST VALVE EQUIPPED SPRAY GUN

BACKGROUND AND SUMMARY OF THE INVENTION

Regular spray guns include two types, one is high pressure type and the other is low pressure type, and both are designed for respectively specific purpose. The high pressure type spray gun directly sucks up the paint from the bottle to the nozzle by means of siphon without permitting high pressure air to enter into the bottle. This high pressure spray gun can provide a fine spraying effect and is most practical for spray painting on cars and furnitures. However, since the high pressure spray gun sucks the liquid material by means of siphon, high concentration paint is be not applicable for use therein and should be diluted to a proper range. The additional process of diluting the painting prolongs the operation and consumes extra diluent. The low pressure type spray gun permits compressed air pressure run to enter into the bottle to help delivery of the paint and is practical for spraying high concentration paint by minimizing operational time and reducing material consumption. However, in order to prevent explosion of the bottle, the pressure applied for low pressure spray gun must be constantly controlled within a low level, such that the pressure at the nozzle may become excessive low and the spraying effect may not be effectively performed. Therefore, the low pressure spray gun is not practical for high quality operation. When using a high pressure spray gun, if air pressure is below 100 psi, the siphon effect will be unable to perform. Therefore, minimum air pressure of over 100 psi is required for operating a high pressure spray gun. When using a low pressure spray gun, if air pressure exceeds 50 psi, the spray bottle cover may break away from the bottle or the bottle may explode. Therefore, air pressure within 50–100 psi is not applicable for use in low pressure spray gun.

In view of said problems, a safety exhaust valve equipped spray gun of the present invention was created for providing a spray gun which is applicable for concomitantly high pressure as well as low pressure operation.

The main object of the present invention is to provide a safety exhaust valve equipped spray gun wherein the spray gun and spray bottle cover are incorporated into one unit with a safety valve provided on the spray bottle cover above the connecting portion, so as to permit a spring leaf to drive a lever to force a steel ball to block the air hole, thereby preventing air leakage at time the limited air pressure range it fixed below 50 psi; or to permit excessive high air pressure which is over 50 psi to push open the steel ball to permit excessive air pressure to be exhausted through an exhaust hole and to permit the inner air pressure to be constantly maintained within 50 psi. Thus, the present invention provides a spray gun with maximum spraying performance, preventing the spray bottle from breaking away from the spray gun or from exploding.

Another object of the present invention is to provide a safety exhaust valve equipped spray gun wherein the air pressure in the spray bottle is constantly maintained within a limited range. The air pressure in the bottle is used to force the liquid material to spray through the nozzle. An air pressure stabilizing is provided at the front of an air induction hole to maintain a constant air pressure for the air induction hole and the nozzle, so as to provide a maximum spraying effect and to provide higher pressure for enhancing performance, and also to provide a practical spray gun for high pressure as well as low pressure spraying operation.

A yet further object of the present invention is to provide a safety exhaust valve equipped spray gun, wherein a bolt is threaded in the bottom of the inner air induction hole. The bolt is arranged to provide a stepped hole with the bottom of the hole having a check spring attached thereto for permitting air to smoothly run into the spray bottle, thereby providing stability. This arrangement also prevents liquid material from running into the air induction hole when the spray bottle is turned upside-down.

The above and other objects, features and advantages of the present invention will be fully understood from the following description considered in connection with the accompanying drawings which illustrate the best mode for practicing this invention.

DETAILED DESCRIPTION OF THE PREFERRED EMBODIMENT

The present invention relates to a safety exhaust valve equipped spray gun and, more particularly, to a spray gun which comprises a safety exhaust valve for maintaining inner air pressure of the container constantly below a limited level while the pressure on nozzle remains unchanged, so as to provide good spraying performance with maximum security.

Figure 1:
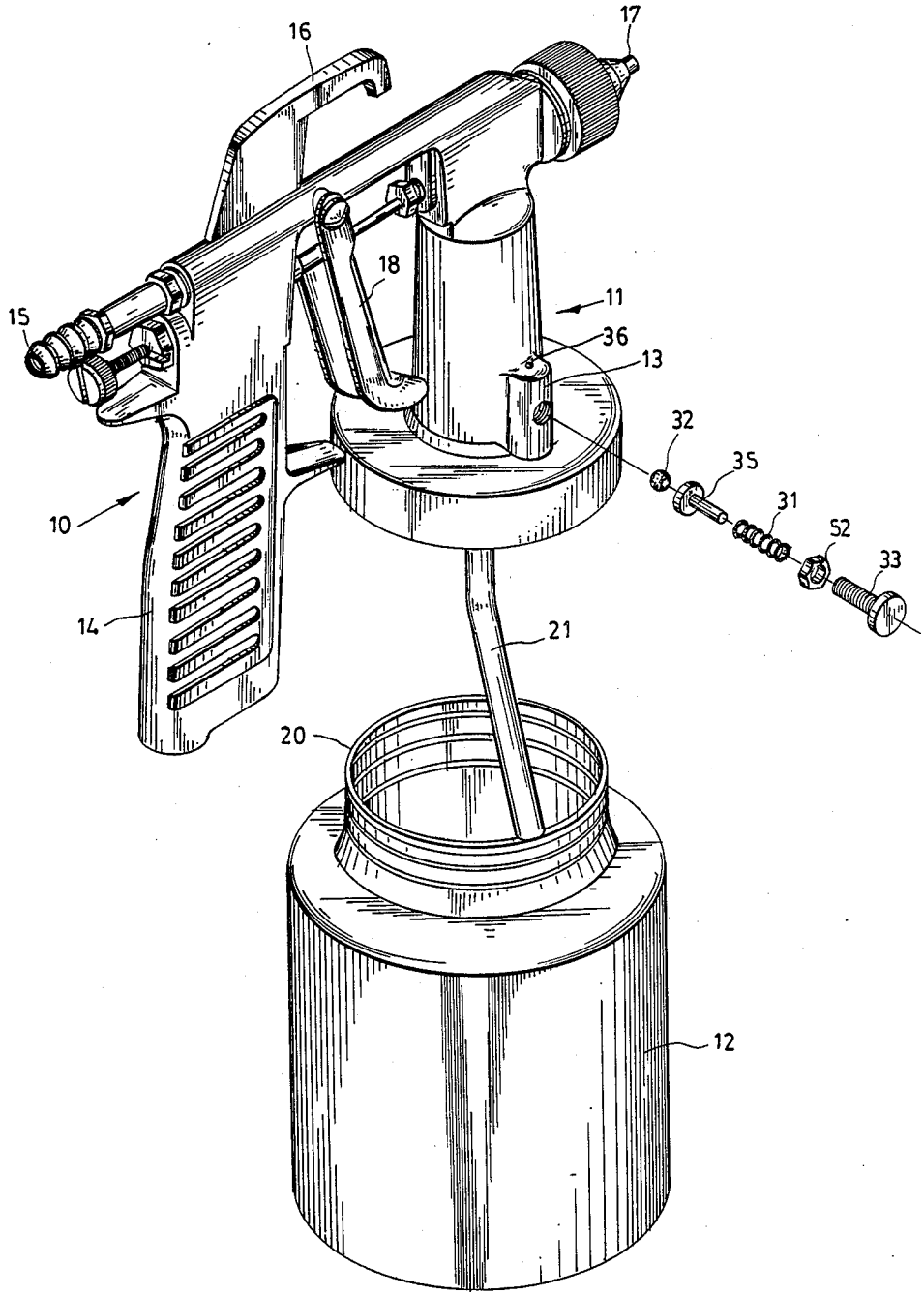
FIG. 1 is a perspective fragmentary view of a safety exhaust valve equipped spray gun embodying the present invention.
Figure 2:
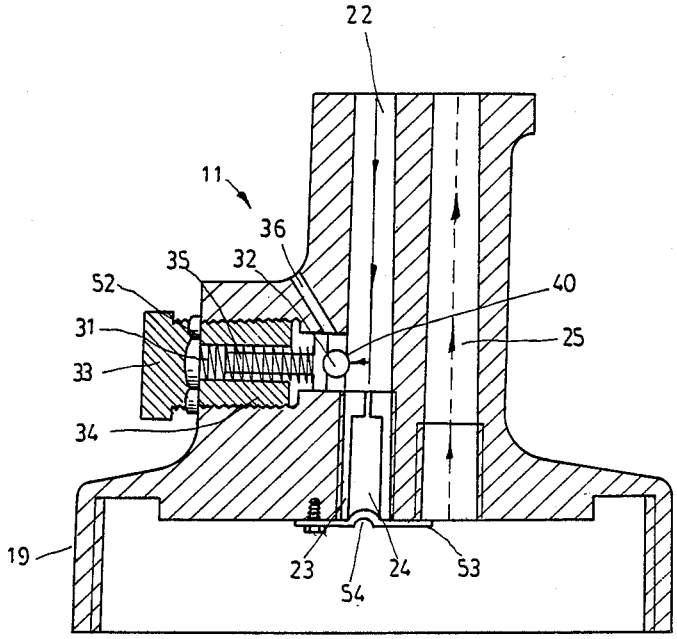
FIG. 2 is a cross sectional view of the exhaust valve of the preferred embodiment according to the present invention.
Figure 3:
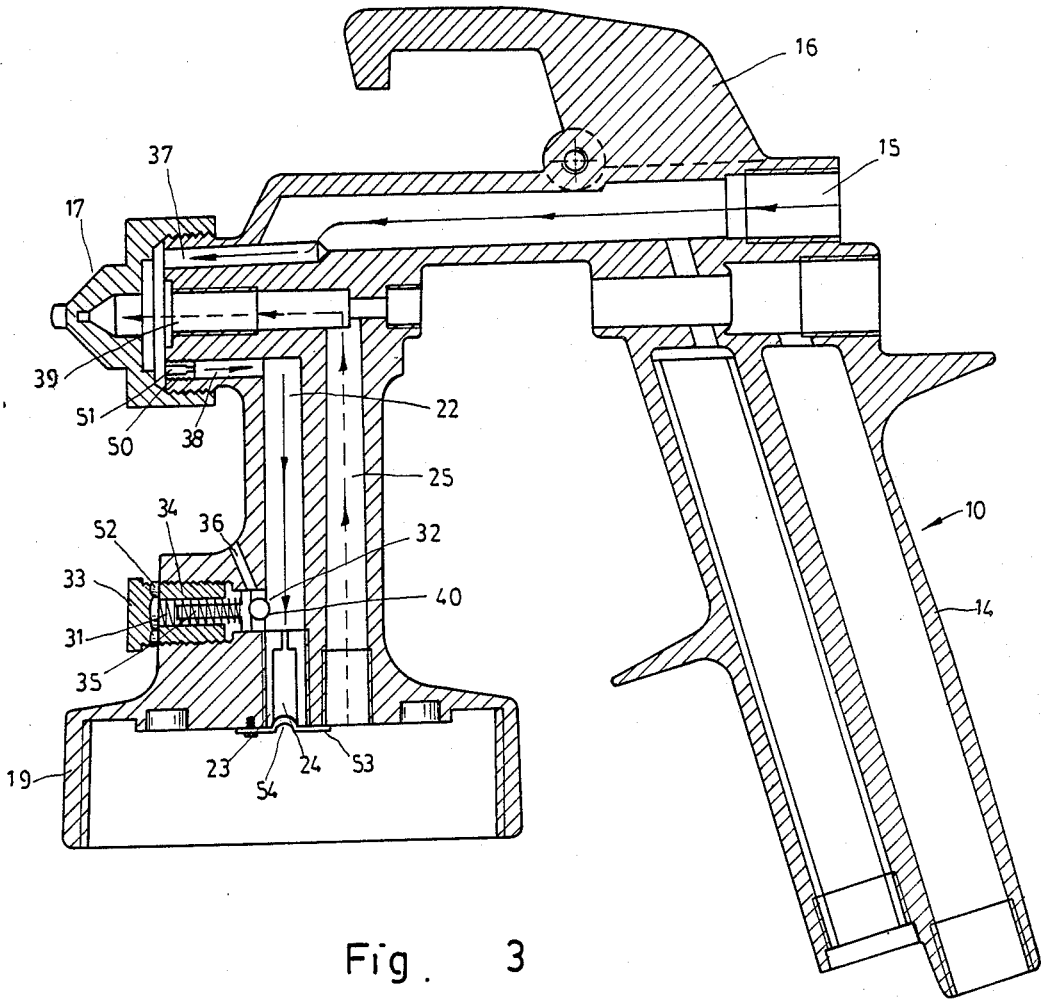
FIG. 3 is a cross sectional view of the preferred embodiment according to the present invention.

Referring to FIGS. 1, 2 and 3, an embodiment according to the present invention comprises a spray gun 10, a spray bottle cover 11, a bottle body 12, and a safety exhaust valve 13, wherein the spray gun 10, spray bottle cover 11 and bottle body 12 are provided in one solid unit. The spray gun comprises a handle 14 having an air inlet 15 provided at the upper side, a hanger 16 provided at the top, a nozzle 17 provided at the other side, and a trigger 18 provided below the hanger 16 to control the opening or closing of the nozzle 17 and the discharge hole 25. The spray bottle cover 11, which is connected with the bottle body 12 by screwing up the connecting portion 19 with the opening 20, comprises a lead pipe 21 inserted therein, an air induction hole 22 extending downward from the spray gun 10 in a diameter of 2 mm with a bolt 23 screwed therein at the bottom. The bolt 23 comprises a stepped hole 24 having an inner diameter about 0.3 mm at the upper portion and a wider diameter at the lower portion. The stepped hole 24, which is designed for air below 50 psi to pass, therethrough comprises a check leaf 53 at the bottom with one end of the check leaf 53 fixedly attached thereto and with the other end freely arranged. The check leaf 53 is arranged to provide a circular convex portion 54 to block the bottom end of said air induction hole 22. The safety air exhaust valve 13 is provided on the spray bottle cover 11 above the connecting portion 19, and comprises an adjusting bolt 33 and a nut 52. The adjusting bolt 33 is threaded into the valve wall from outside, having an opening 34 therein for a lever 35 to set therein with a spring 31 mounted thereon. The lever 35 is arranged to provide a steel ball 32 at the front to block an air hole 40. An exhaust hole 36 is provided on the top of the valve. The spray gun 10 comprises a pressure stabilizing bolt 50 arranged at the front of a stepped air hole 51 with right-hand outlet of the hole arranged to provide a caliber about 0.5 mm.

While in operation, air pressure is compressed from the air inlet 15 through air induction 37, nozzle 17, air induction hole 38, and stepped hole 24 into the bottle 12 (as illustrated in FIG. 3) to compress the liquid in the bottle 12 so as to force the liquid to flow along lead pipe 21, discharge hole 25, passage 39, and then the liquid is ejected outward through the nozzle 17 (as illustrated in FIG. 3 along dotted lines and arrows). By means of the arrangement of the pressure stabilizing bolt 50, the pressure on the nozzle 17 and the air induction hole 37 remains unchanged and the discharge from the discharge hole 25 is maintained at a constant level. Therefore, the liquid is sprayed outward like a vapor. The higher the pressure is provided, the better the performance will be. Better performance can be applied for high precision operation. If the induction pressure is arranged within limited level of 50 psi, the spring force of the spring 31 will drive the lever 35 to force the steel ball 32 to block the air hole 40 to prevent air leakage. If the induction pressure exceeds the limited level of 50 psi, the excessive air pressure can not pass through said stepped hole 24 since the stepped hole 24 is arranged for air pressure below 50 psi to pass therethrough. Therefore, the excessive air pressure will flow through the air hole 40 to open the stopped steel ball 32 and then be exhausted from the exhaust hole 36 via the air hole 40, and the air pressure inside the bottle body 12 will remain within 50 psi. The arrangement of the check leaf 53 permits the air pressure to be smoothly pressed into bottle body, and prevents the liquid from flowing backward into the air induction hole if the bottle is turned upside-down.

In general, the present invention is arranged to provide a safety air exhaust valve combined with a spray bottle cover and a spray gun into one consolidated unit, so that air pressure over a limited air pressure is exhausted. A stepped hole is provided for maintaining the air pressure in the bottle body within a limited range which prevents the bottle body from breaking away from the spray bottle cover and from exploding due to an excessive high air pressure. According to the present invention, the spray gun can provide good spraying performance, maximum security, and is applicable for high as well as for low air pressure operation.

I claim:

1. A safety exhaust valve equipped spray gun, which comprises a spray gun incorporated with a spray bottle cover in one solid unit above a connecting portion connecting said one solid unit to a bottle body, said spray bottle cover including a safety exhaust valve means for exhausting excess air pressure and an air induction means for maintaining pressure within a limited value;

said exhaust valve means including an adjusting bolt threaded into a wall of said spray bottle cover with a nut fixed thereon, said wall having an exhaust hole on its top side; and a lever coupled to said adjusting bolt through a spring, said lever having a steel ball covering an air hole communicating with said exhaust hole; and said air induction means including an air induction hole provided inside said spray bottle cover and having a bolt threaded therein at its bottom, said bolt providing a stepped hole means for permitting air below 50 psi to pass therethrough, exhausting excessive air pressure through said exhaust hole and controlling air pressure inside said bottle body within said limited value, said stepped hole means including a stepped hole with an inner diameter about 0.3 mm at its upper portion and a wider diameter at its lower portion, a check leaf at its bottom with one end of said check leaf fixedly attached adjacent to said stepped hole and with another end freely arranged, said check leaf having a circular convex portion blocking a bottom end of said air induction hole.

2. A safety exhaust valve equipped spray gun according to claim 1, wherein a pressure stabilizing bolt is provided on the air induction hole at a front end of said spray gun, said bolt cooperating with a stepped air hole having an outlet of a caliber of 0.5 mm.

* * * * *